US009345943B2

(12) United States Patent
Kong

(10) Patent No.: US 9,345,943 B2
(45) Date of Patent: May 24, 2016

(54) GOLF COACH BOX

(75) Inventor: Lingen Kong, Shenzhen (CN)

(73) Assignee: Shenzhen Lianrunda Container Management Service Co., LTD, Shenzhen (CN)

( * ) Notice: Subject to any disclaimer, the term of this patent is extended or adjusted under 35 U.S.C. 154(b) by 598 days.

(21) Appl. No.: 13/825,062

(22) PCT Filed: Sep. 16, 2011

(86) PCT No.: PCT/CN2011/079720

§ 371 (c)(1),
(2), (4) Date: Mar. 19, 2013

(87) PCT Pub. No.: WO2012/034533

PCT Pub. Date: Mar. 22, 2012

(65) Prior Publication Data

US 2013/0184093 A1 Jul. 18, 2013

(30) Foreign Application Priority Data

Sep. 19, 2010 (CN) ..... 2010 2 0535609 U
Mar. 11, 2011 (CN) ..... 2011 1 0058886

(51) Int. Cl.
*A63B 69/36* (2006.01)
*A63B 71/06* (2006.01)

(52) U.S. Cl.
CPC ..... *A63B 69/36* (2013.01); *A63B 69/3644* (2013.01); *A63B 69/3652* (2013.01); *A63B 69/3667* (2013.01); *A63B 69/3673* (2013.01); *A63B 71/0686* (2013.01)

(58) Field of Classification Search
USPC ..... 473/216, 229, 257, 259, 200, 258
See application file for complete search history.

(56) References Cited

U.S. PATENT DOCUMENTS

| | | | | |
|---|---|---|---|---|
| 1,567,530 | A * | 12/1925 | MacNaughton | A63B 69/3641 473/229 |
| 3,339,927 | A * | 9/1967 | Nunn | A63B 69/3644 248/455 |
| 5,429,367 | A | 7/1995 | Amos | |
| 5,984,798 | A * | 11/1999 | Gilmour | A63B 69/3644 473/221 |
| 6,863,619 | B2 * | 3/2005 | Blacklock | A63B 69/3632 473/259 |
| 7,074,133 | B1 * | 7/2006 | Jones | A63B 69/3641 473/226 |

(Continued)

FOREIGN PATENT DOCUMENTS

| | | |
|---|---|---|
| CN | 1633319 | 6/2005 |
| CN | 102166410 | 8/2011 |

(Continued)

OTHER PUBLICATIONS

International Search Report for international application No. PCT/CN2011/079720, dated Dec. 22, 2011 (4 pages).

*Primary Examiner* — Nini Legesse
(74) *Attorney, Agent, or Firm* — Hamre, Schumann, Mueller & Larson, P.C.

(57) ABSTRACT

Disclosed is a golf coach box, including a batting box and an arch swing plane sliding rail. One end of the swing plane sliding rail is rotatably fixed to the batting box and the other end thereof is connected via a telescopic connecting mechanism to the batting box. The beneficial effect of the present application as compared with the prior art is: the batting box is additionally provided with the swing plane sliding rail, used to simulate a swing plane during batting, thereby having a function of guiding a user to swing correctly during a batting process.

43 Claims, 7 Drawing Sheets

(56) References Cited

U.S. PATENT DOCUMENTS

| | | | | |
|---|---|---|---|---|
| 7,597,632 | B2 * | 10/2009 | Edwards | A63B 69/3641 473/257 |
| 7,874,931 | B2 * | 1/2011 | Liao | A63B 69/3641 473/257 |

FOREIGN PATENT DOCUMENTS

| | | |
|---|---|---|
| CN | 202028151 | 11/2011 |
| JP | 6-304277 | 11/1994 |
| WO | 2008/071031 | 6/2008 |

* cited by examiner

GOLF COACH BOX

CROSS REFERENCE TO RELATED APPLICATIONS

This application is a national phase application of PCT/CN2011/079720, filed on Sep. 16, 2011. The contents of PCT/CN2011/079720 are all hereby incorporated by reference.

BACKGROUND

1. Technical Field

The present application relates to a golf training apparatus, and in particular, to a movable golf coach box.

2. Related Art

Currently, a well-known golf training system is formed by a square platform and a fixed operating box connected to each other, the platform producing a slope under a hydraulic pressure function. The system has the disadvantages of a relatively large volume and non-mobility. In particular, it cannot be placed on a grass sod for use, and the adopted alternating current (AC) electricity and the hydraulic pressure go against safety and environmental protection. Only an up-slope, a down-slope, a left-slope, and a right-slope are provided without a device for simulating a swing plane. A training condition for a special golf lie is not essentially provided. Currently, another well-known golf training system is a circular iron hoop formed by a metal tube and connected to a ground fixation footboard via two support poles, a metal rolling rod being used for simulating a swing action on the iron hoop. The system has the disadvantages that a golf club cannot be used on the iron hoop for batting training because the club may be damaged, a batting effect cannot be sensed by using the rolling rod, and a golf swing arc is not a perfect circle.

SUMMARY

The technical problem to be solved by the present application is to provide a golf coach box, capable of adopting a swing plane simulating device for guiding a user to conduct swing batting training correctly.

The technical problem of the present application is solved through the following solutions.

A golf coach box includes a batting box and an arch swing plane sliding rail, one end of the swing plane sliding rail being rotatably fixed to the batting box and the other end thereof being connected via a telescopic connecting mechanism to the batting box.

Preferably, the telescopic connecting mechanism is a telescopic rod or a telescopic cylinder, one end of the telescopic rod or the telescopic cylinder being rotatably connected to the swing plane sliding rail and the other end thereof being rotatably and detachably fixed to an outer edge of the batting box.

The swing plane sliding rail is provided with a swing rhythm display. The rhythm display preferably adopts an LED display. A user is prompted by flashing light of the LED on the swing plane to control a swing speed.

Preferably, the batting box includes a lifter disk, a base plate, and a lifter mechanism, one end of the lifter disk being rotatably connected to one end of the base plate and the other end of the lifter disk being connected via the lifter mechanism to the other end of the base plate.

Preferably, the lifter mechanism is a cam lifter mechanism. The cam lifter mechanism includes a direct current (DC) motor, sector cams, a cam shaft, and bracket bearings, the bracket bearings being fixed on the base plate, the cam shaft being rotatably mounted on the bracket bearings and the cam shaft being further connected to the DC motor in a transmission way, the sector cams being fixed on the cam shaft, and rolling wheels being mounted on a sector surface of each sector cam and the rolling wheels pressing against a lower surface of the lifter disk.

Preferably, the lifter mechanism further includes synchronizing wheels and belts, the synchronizing wheels being provided on the cam shaft in a sleeve way, and one end of each belt being fixed to each synchronizing wheel and the other end thereof being fixed to the lifter disk.

Preferably, the bottom of the base plate is provided with a rotating disk and at least two rotating wheels, a lower surface of the rotating disk being positioned at the same horizontal plane with lower ends of the rotating wheels.

Preferably, the rotating disk includes an upper support tray and a lower support tray, the upper support tray being rotatably fixed on the lower support tray.

Preferably, the golf coach box further includes a laser addressing device, used to guide a user to choose a correct stance and club face during batting setup and target addressing.

The beneficial effect of the present application as compared with the prior art is: the batting box is additionally provided with the swing plane sliding rail, used to simulate a swing plane during batting, thereby having a function of guiding a user to swing correctly during a batting process.

In a preferable solution, the swing plane sliding rail is provided with a swing rhythm display, capable of further guiding the user to choose a correct swing speed.

In a preferable solution, setting of the lifter mechanism enables the coach box to simulate different slopes, so that the user can conduct batting training for different slopes.

In a preferable solution, the batting box is provided with a lifter mechanism, so that the batting box is capable of presenting a certain slope angle, and influences of the slope on the swing plane can be intuitively reproduced.

In a preferable solution, setting of the laser addressing device assists the user to conduct batting addressing practices for various paths.

In a preferable solution, different positions such as a start swing, back swing, down swing, release, batting, and forward swing locations are marked with different colors on the swing plane sliding rail in a segmental way, capable of prompting the user to master a swing arc and control a carry of the ball.

DETAILED DESCRIPTION

Figure 1:
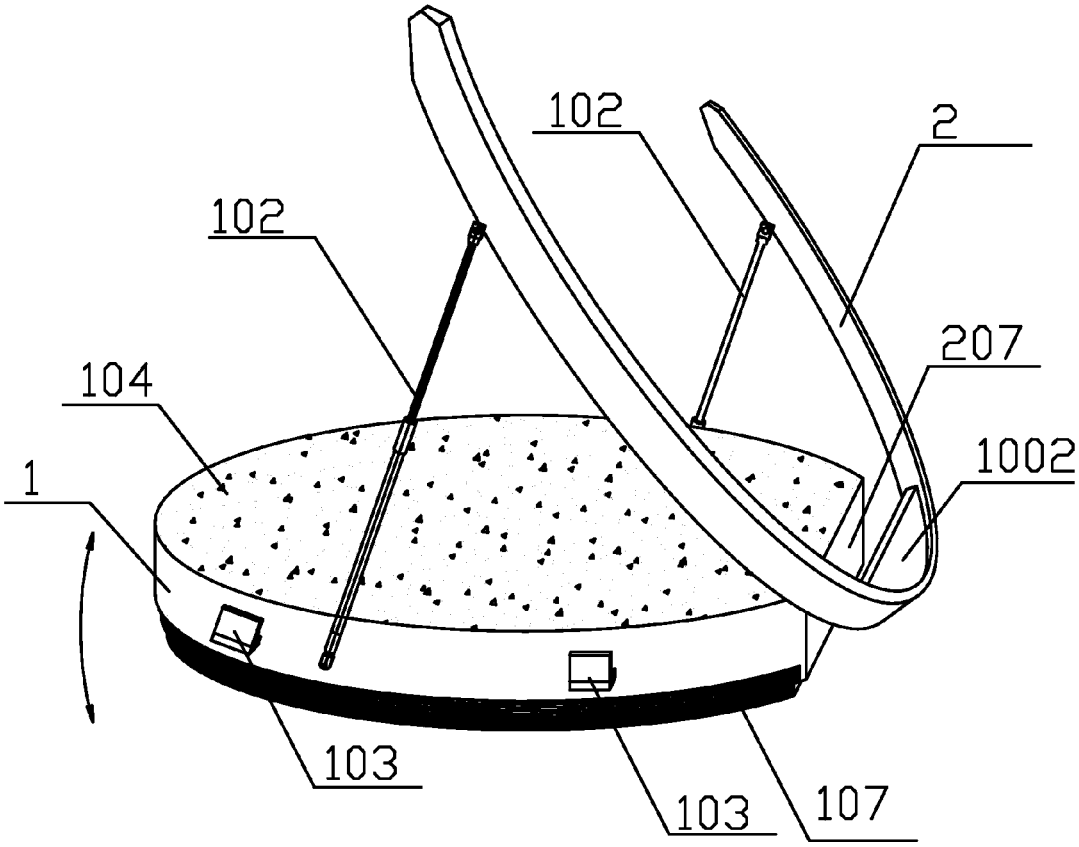
FIG. 1 is a three-dimensional diagram of a golf coach box according to Embodiment 1 of the present application (a batting box is in horizontal state)
Figure 2:
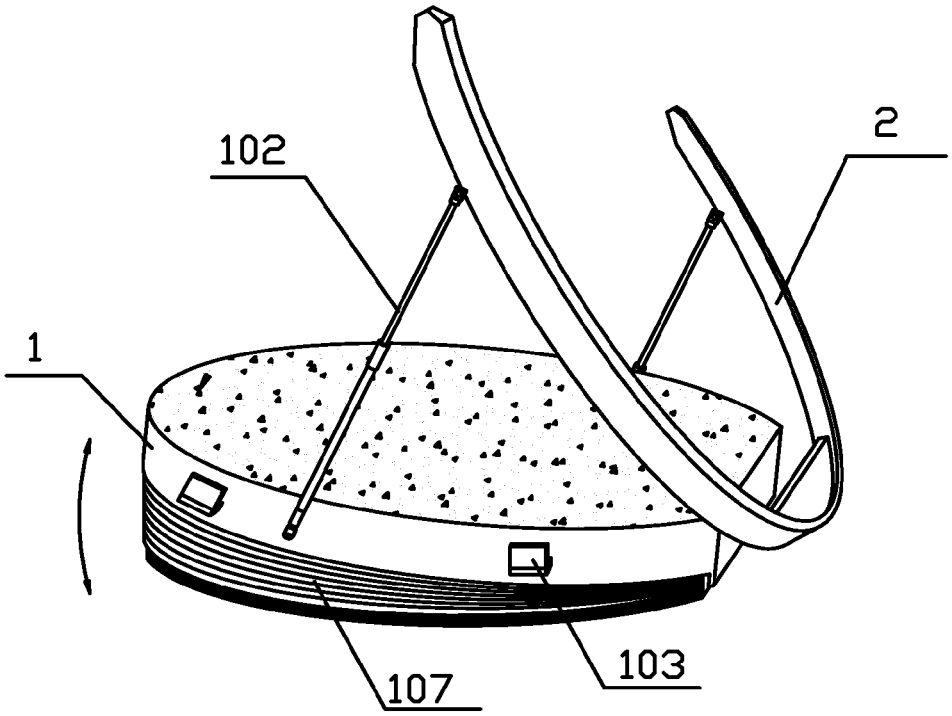
FIG. 2 is a three-dimensional diagram of a golf coach box according to Embodiment 1 of the present application (a batting box is in slope state)

The following describes the present application in detail in combination with the preferable specific embodiments with reference to the accompanying drawings.

Embodiment 1

As shown in FIG. 1 to FIG. 4, a golf coach box in this embodiment includes a batting box 1 and a swing plane sliding rail 2. The batting box takes a circular shape on the whole and the swing plane sliding rail 2 takes an arch shape on the whole. A lifter pin base 101 is fixed to one end of an outer edge of the batting box. A lifter pin 1001 is mounted, capable of being lifted up and down, in the lifter pin base 101. A free end of the lifter pin 1001 is connected to a lifter pin connecting plate 1002 provided at a central point of the swing plane sliding rail 2. The swing plane sliding rail 2 is provided with telescopic rod retaining pins at positions close to both ends thereof, and is detachably connected via the retaining pins to a free end of a telescopic rod 102. The other end of the telescopic rod 102 is connected to retaining pins separately provided at two side edges of the batting box 1. After the swing plane sliding rail 2 and the batting box 1 are connected via the telescopic rod, an included angle between the swing plane sliding rail 2 and the batting box 1 can be adjusted conveniently by adjusting a telescoping degree of the lifter pin 101 and the telescopic rod 102. The included angle preferably has a maximum value of 65° and a minimum value of 0° (in non-use state when the included angle is 0°), thereby adapting to batting requirements for different clubs. Swing plane sliding rail reset fixation mechanisms 103 are further provided on the two side edges of the batting box 1. When it is unnecessary to use the swing plane sliding rail 2, the swing plane sliding rail 2 may be reset and fixed to the outer edge of the batting box by detaching the telescopic rod 102 and moving the lifter pin 1001, so that this coach box can serve as a training box for the user to conduct batting without the swing plane sliding rail.

The method for using the swing plane sliding rail of the golf coach box of the present application is: a user correctly grips a club and stands on the batting box 1, erects a portion of the club near a club head on the swing plane sliding rail 2, and sways the club up and down along the swing plane sliding rail 2 to bat a ball during the swing, so as to master swing concepts.

Figure 4:
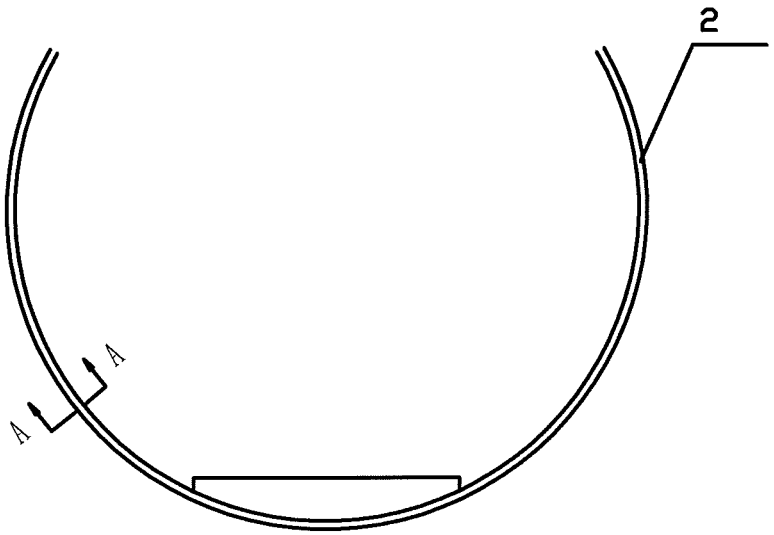
FIG. 4 is a schematic structural diagram of a swing plane sliding rail of a golf coach box according to Embodiment 1 of the present application.
Figure 5:
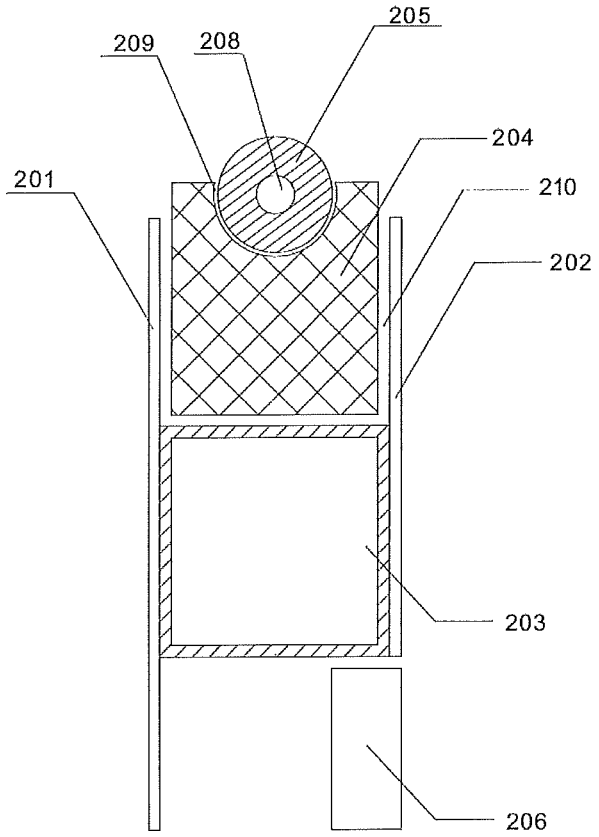
FIG. 5 is a cross-sectional view along an A-A line in FIG. 4.

As shown in FIG. 4 and FIG. 5, the swing plane sliding rail 2 of the present application includes a swing plane sliding rail body formed by an outer guard plate 201, an inner guard plate 202 and a square tube 203, a square rubber shock absorption pad 204, a nylon strip track 205, a swing rhythm display 206, and a U-shaped groove 210, a recess 209. The outer guard plate 201 is wider than the inner guard plate 202. The outer guard plate 201 and the inner guard plate 202 are connected and fixed to each other via the square tube 203. After the fixation, the U-shaped groove 210 is formed above the square tube 203. The width of the square rubber shock absorption pad 204 is approximate to the opening width of the U-shaped groove 210, so that the square rubber shock absorption pad can be just clamped in the U-shaped groove 210. The height of the square rubber shock absorption pad 204 is greater than the depth of the U-shaped groove 210, so that an upper end of the square rubber shock absorption pad 204 is higher than top ends of the inner guard plate 202 and the outer guard plate 201 after the square rubber shock absorption pad 204 is clamped in the U-shaped groove 210. The upper end of the square rubber shock absorption pad 204 is provided with the recess 209 for mounting the nylon strip track 205. The nylon strip track 205 is fixed in the recess 209 with elasticity of the square rubber shock absorption pad 204. The swing rhythm display 206 includes a plurality of LED indicator lights. The LED indicator lights are arranged on a lower end of the inner guard plate 202 and may be fixed thereto via the inner guard plate 202 or the square tube 203. In practice, the LED indicator lights may also be mounted at an inner side of the outer guard plate 201. On-off control of all the plurality of LED indicator lights is performed by the same control chip. A swing rhythm is indicated by controlling lighting-up and lighting-off of the LED lights. For example, all the LED indicator lights are turned on in advance and then are turned off from a top end of the swing plane sliding rail 2 in sequence, and a swinger controls a club and a swing speed so that the club is always maintained at a joint between a turned-off LED light and a turned-on LED light. To satisfy training requirements, different lighting-off speeds may be set in the control chip. In a further solution, a control chip with a remote receiver may be adopted and the remoter is utilized to switch among different lighting-off speeds, so as to facilitate user's operations.

The nylon strip track 205 is preferably made of a nylon material with a smooth surface. In this embodiment, a transparent or a semi-transparent hollow nylon strip track is adopted, a flexible neon line 208 (also referred to as an Electroluminescent (EL) wire) passes through the hollow of the nylon strip track 205, and a battery is utilized to supply power to the EL wire. During use in night, the EL wire is turned on, so that a user can clearly view a swing track thereof. The EL wire is preferably an EL wire which takes a green appearance and emits green light.

The function of the square rubber shock absorption pad 204 lies in buffering a pressure of the club on the swing plane sliding rail 2 and reducing abrasion of the club caused by the swing plane sliding rail 2.

In this embodiment, segmentation marks with different color patterns are coated on the inner guard plate and the outer guard plate of the swing plane sliding rail. The segmentation marks include one or more of a start swing segment mark, a back swing segment mark, a down swing segment mark, a release segment mark, a batting segment mark and a forward swing segment mark, used for prompting a user to master a swing arc and control a carry of the ball.

Figure 6:
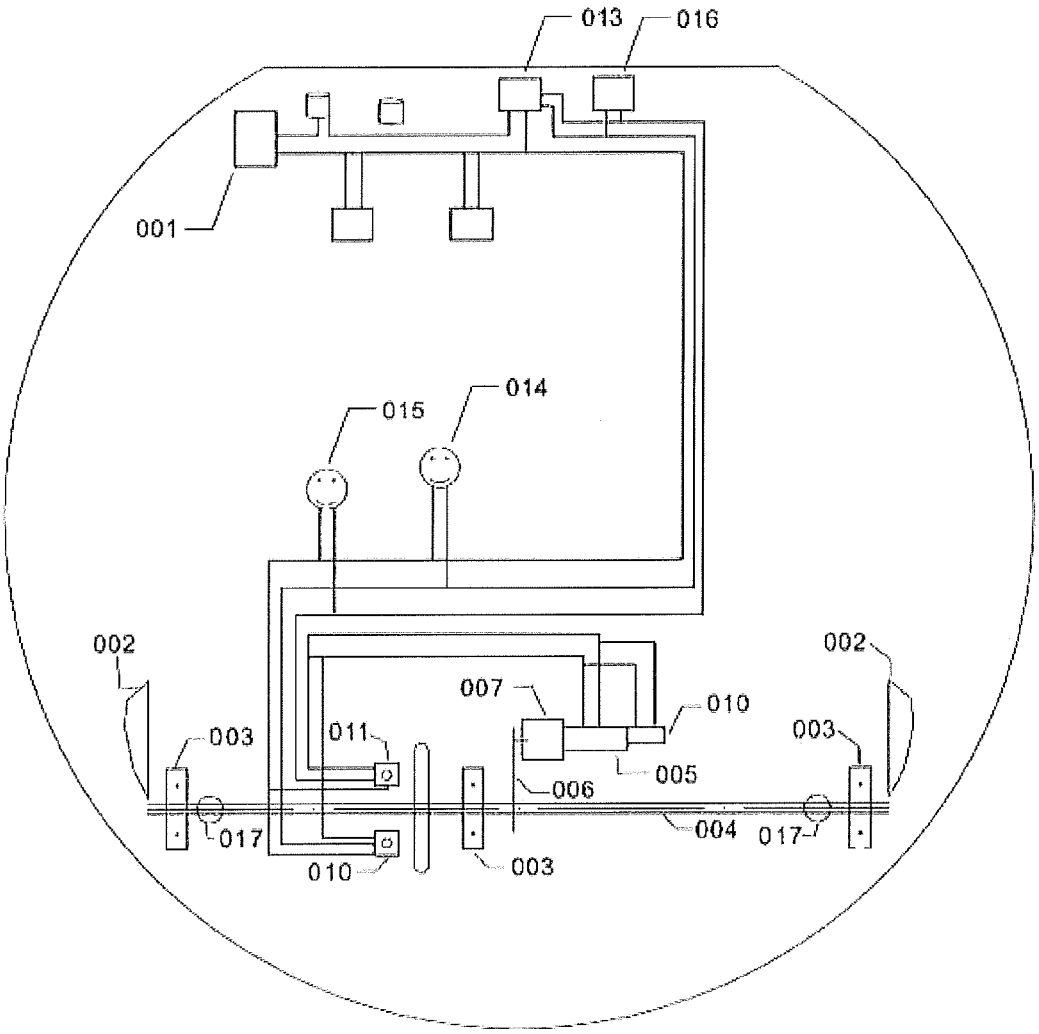
FIG. 6 is a schematic structural diagram of a lifter mechanism according to Embodiment 1 of the present application.

As shown in FIG. 1, FIG. 2, FIG. 3, and FIG. 6, in this embodiment, the body of the batting box 1 is formed by a batting mat 104, a lifter disk 105, a base plate 106, a lifter mechanism, and an organ-type dust shield 107. The lifter disk 105 is a steel plate taking a circular shape on the whole. The batting mat 104 is placed on the lifter disk 105. A lifter pin connecting plate 207 is provided on one side of the lifter disk 105. The side of the lifter disk 105 where the lifter pin connecting plate 207 is provided is rotatably connected to one side of the base plate 106. The lifter mechanism is provided between the lifter disk 105 and the base plate 106 and is used to control ascending and descending of the lifter disk 105, so that a certain slope angle is formed for the lifter disk 105 with respect to the horizontal plane. The lifter mechanism may adopt various lifter mechanisms which are well known by persons skilled in the art, as long as the effect that a certain slope angle is formed for the lifter disk 105 with respect to the horizontal plane can be achieved. As shown in FIG. 6, in this embodiment, the lifter mechanism adopts a cam lifter device. A DC motor 005 is utilized to drive sector cams 002 to rotate to control a distance between the lifter disk 105 and the base plate 106, so as to achieve ascending and descending of the lifter disk 105. The following describes the specific structure of the cam lifter device.

Three bracket bearings 003 are fixed on the base plate 105 separately. The three bracket bearings 003 are positioned at the same straight line. A cam shaft 004 is fixed by the three bracket bearings 003. One end of each of two sector cams 002 is separately fixed on each of two ends of the cam shaft 004. Four rolling wheels are mounted on a sector surface of each sector cam 002 separately. The rolling wheels are used to press against a lower surface of the lifter disk, so that a transmission connection between the sector cams 002 and the lifter disk is formed. The cam shaft 004 is driven to rotate by the DC motor 005 via a chain 006. A gear reducer 007 is further provided between the DC motor 005 and the chain 006. The DC motor 005 is powered by a 12-V DC power supply 001 and is controlled by a breakpoint brake 010 to turn on or off. The lifter principle of the lifter mechanism is: the lifter disk 105 is stabilized on the base plate 006 by depending on support of the rolling wheels on the two sector cams 002. Moreover, a difference in contact position and angle between the rolling wheels on the sector cams 002 and the lifter disk 105 may cause a difference in distance between the lifter disk 105 and the cam shaft 004, namely, a difference in distance between the lifter disk 105 and the base plate 106. Therefore, when the DC motor 005 drives the cam shaft 004 and further drives the cams 002 to rotate, contact positions between the cams 002 and the lifter disk 105 also change accordingly, and further a lifter effect is formed. The lifter mechanism further includes synchronizing wheels 017 and belts. The synchronizing wheels 017 are provided on the cam shaft 004 in a sleeve way. One end of each belt is fixed to each synchronizing wheel 017 and the other end thereof is fixed to the lifter disk 105. A proper length is set for the belts, so that the belts may be rolled up around the synchronizing wheels 017 due to rotation of the cam shaft 004 when the lifter disk 105 descends, and that the belts are unrolled due to rotation of the cam shaft 017 when the lifter disk 105 ascends, where the length of the belts after the unrolling is equal to the distance between the lifter disk and the base plate, thereby preventing the lifter disk 105 from entirely departing from the base plate 106 due to an external force no matter where the lifter disk is located. In this embodiment, the lifter mechanism is further provided with a low level control switch 011 and a high level control switch 012, used to control forward rotation and reverse rotation of the DC motor 005, so as to control ascending and descending of the lifter disk. Power supply input ends of the low level control switch 011 and the high level control switch 012 both are electrically connected to an output end of a lifter controller 013. The lifter controller 013 controls on-off of the low level control switch 011 and the high level control switch 012. A power supply input end of the lifter controller 013 is connected to the DC power supply 001. A buzzer 014 and a buzzer 015 are provided respectively between the lifter controller 013 and the low level control switch 011 and between the lifter controller 013 and the high level control switch 012 and are used to prompt that ascending and descending are being performed. A lifter indicator light 016 is electrically connected to the lifter controller 013. When the lifter controller 013 works, the lifter indicator light 016 emits light to prompt that the lifter mechanism is performing the ascending and descending. In specific implementation, a remote device may be adopted to control the lifter controller 013, so as to facilitate user's operations.

Figure 3:
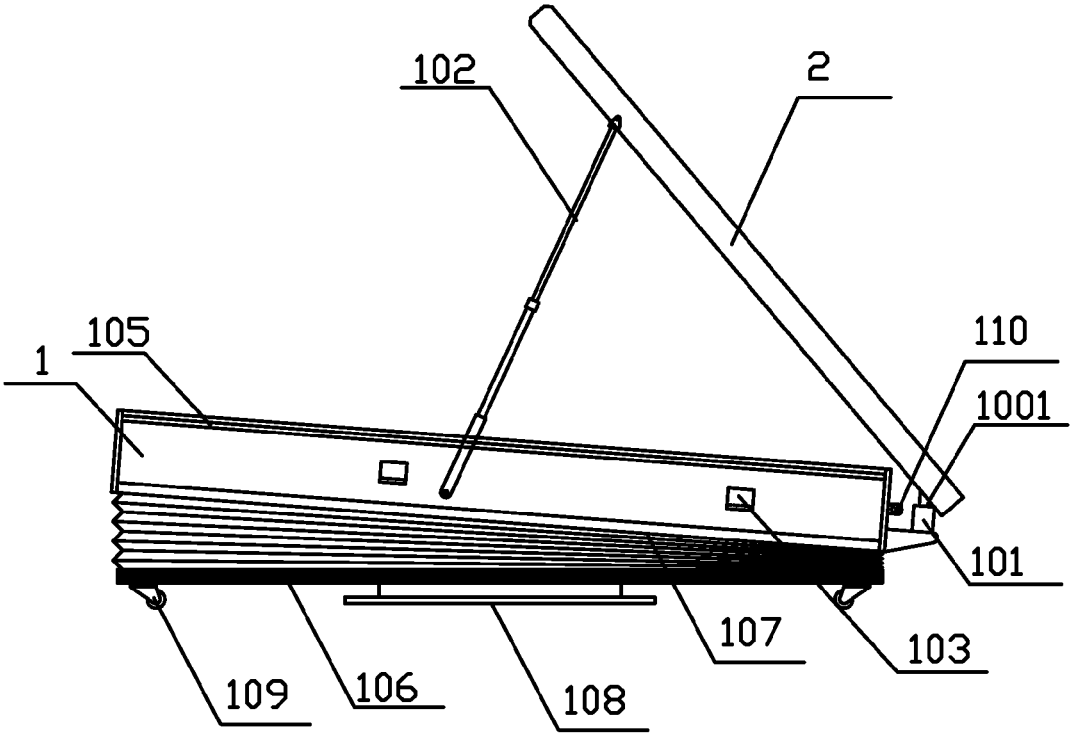
FIG. 3 is a front view of the golf coach box in FIG. 2.

As shown in FIG. 3, in this embodiment, a rotating disk 108 and at least two rotating wheels 109 are provided at the bottom of the base plate 106 of the batting box 1. A lower surface of the rotating disk 108 is positioned at the same horizontal plane with grounding points of the rotating wheels 109. The batting box 1 is placed on an indoor floor or an outdoor grass sod via the rotating disk 108 without fixation with an auxiliary facility, thereby achieving mobility of the coach box. Since the lower surface of the rotating disk 108 and the grounding points of the rotating wheels 109 are positioned at the same horizontal plane, rotation of the batting box 1 can be achieved as long as the batting box 1 is slightly pushed without uplifting the whole batting box 1. Moreover, the collaboration between the rotating disk and the lifter mechanism may enable the batting box to simulate at least nine different batting slopes.

As shown in FIG. 3, two laser addressing devices 110 are further provided in parallel on the base plate 106 of the batting box 1. The laser addressing devices 110 adopt laser addressing devices whose light paths can be adjusted, and preferably, adopt laser addressing devices which emit green light beams, so as to guide user's practice of a stance during batting setup and a club face during target addressing.

Embodiment 2

The difference between this embodiment and Embodiment 1 only lies in the design of the base plate and the rotating disk. The base plate of Embodiment 1 still seems slightly cumbersome although the base plate can achieve rotation of the batting box 1 through collaboration between the rotating disk and the rotating wheel. The design of the base plate in this embodiment makes the rotation of the batting box lighter, more convenient, and safer.

Figure 7:
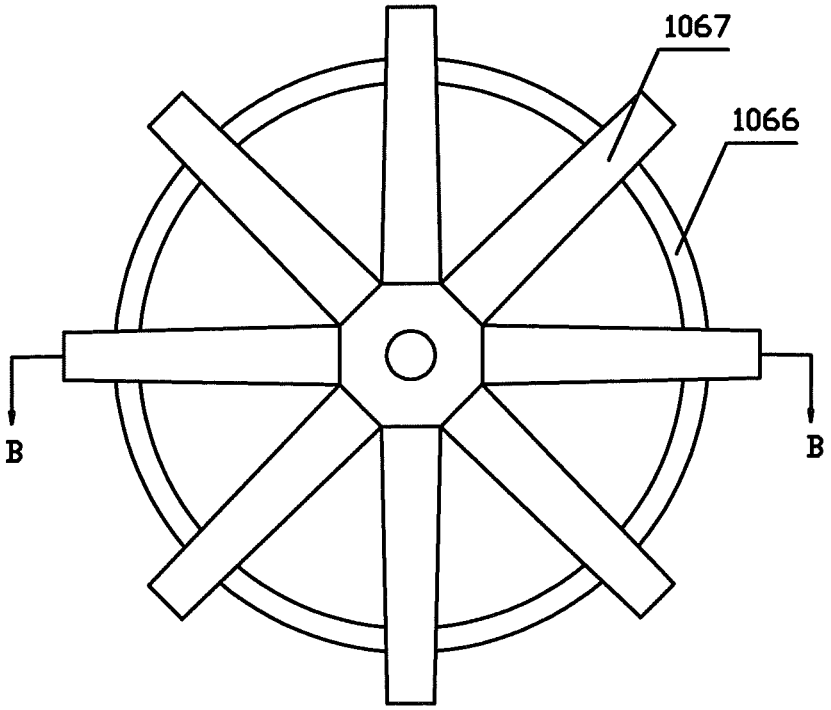
FIG. 7 is a schematic structural diagram of a rotating disk according to Embodiment 2 of the present application (top view)
Figure 8:
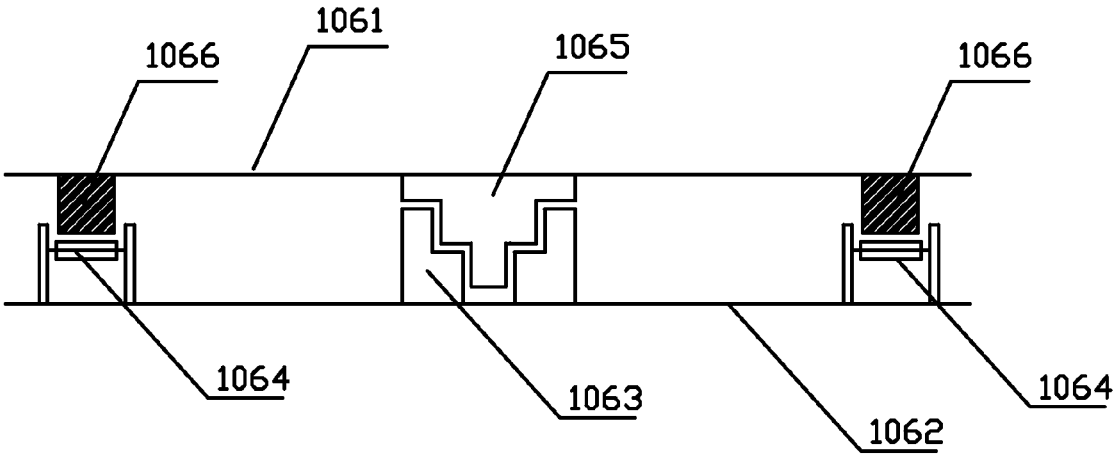
FIG. 8 is a sectional view along a B-B line of the rotating disk in FIG. 7.

As shown in FIG. 7 and FIG. 8, in this embodiment, the base plate 106 is a circular steel plate. The base plate is fixed on a rotating disk. The rotating disk includes an upper support tray 1061 and a lower support tray 1062, the upper support tray 1061 being rotatably fixed to the lower support tray 1062. The specific structure of the base plate is described below. The lower support tray 1062 is an eight-claw-shaped steel frame, formed by eight support arms connected to an octangle steel plate, where a central position of the octangle steel plate is provided with a bearing base 1063, and an end of each support arm is provided with a roller 1064. The upper support tray 1061 is also an eight-claw-shaped steel frame, formed by eight support arms 1067 connected to an octangle steel plate, where a central position of the upper support tray 1061 is provided with a bearing 1065 corresponding to the bearing base 1063, and a circular rail 1066 corresponding to the roller 1064 is fixed on each support arm. An upper support arm 1061 and a lower support arm 1062 may be connected together in a relative rotating manner through collaboration between the bearing 1065 and the bearing base 1063 and between the roller 1064 and the rail 1066. An upper surface of the upper support arm 1061 is connected to the base plate 1061 in a fixation way. The rotation of the batting box can be achieved as long as the batting box is slightly pushed when it is necessary to rotate the batting box.

It is necessary to further provide a gyration braking mechanism between the upper support tray 1061 and the lower support tray 1062, used to fix a relative position between the upper support tray 1061 and the lower support tray 1062 when it is unnecessary to rotate the batting box. The braking mechanism may be achieved by adopting a plurality of forms. For example: corresponding pin holes are provided on the upper support tray 1061 and the lower support tray 1062, and when it is unnecessary to rotate, the braking can be achieved by passing a pin through the corresponding pin holes provided on the upper support tray 1061 and the lower support tray 1062 at the same time.

The above content further describes the present application in the specific preferable embodiments in detail, but it cannot be considered that the specific embodiments of the present application are only limited to the above description. Person skilled in the art to which the present application belongs may make some equivalent replacements or obvious variations without departing from the inventive concept of the present application, and the performance and uses are the same, all of which should fall into the protection scope of the present application.

What is claimed is:

1. A golf coach box, comprising:

a batting box; and an arch swing plane sliding rail, one end of the swing plane sliding rail is rotatably fixed to the batting box and the other end thereof is connected via a telescopic connecting mechanism to the batting box, wherein the swing plane sliding rail includes:

a swing plane sliding rail body, wherein an upper end of the swing plane sliding rail body is provided with a U-shaped groove, a square rubber shock absorption pad, wherein an upper end of the square rubber shock absorption pad includes a recess, and wherein the square shock absorption pad is mounted in the U-shaped groove, and a nylon strip track, the nylon strip track is mounted in the recess.

2. The golf coach box according to claim 1, wherein setting of the telescopic connecting mechanism enables an included angle formed between the swing plane sliding rail and the batting box to range from 0° to 65°.

3. The golf coach box according to claim 1, wherein the swing plane sliding rail further comprises a flexible neon line; and the nylon strip track is a transparent or semi-transparent hollow nylon strip track, the flexible neon line passing through the hollow nylon strip track.

4. The golf coach box according to claim 1, wherein the swing plane sliding rail is provided with a swing rhythm display.

5. The golf coach box according to claim 1, wherein the swing rhythm display is LED indicator lights, the LED indicator lights being arranged on an inner side of the swing plane sliding rail body.

6. The golf coach box according to claim 1, further comprising a laser addressing device.

7. The golf coach box according to claim 6, wherein the laser addressing device is mounted on the batting box.

8. The golf coach box according to claim 1, wherein the batting box comprises a lifter disk, a base plate, and a lifter mechanism, one end of the lifter disk being rotatably connected to one end of the base plate and the other end of the lifter disk being connected via the lifter mechanism to the other end of the base plate.

9. The golf coach box according to claim 8, wherein the lifter mechanism is a cam lifter mechanism, the cam lifter mechanism comprising a direct current (DC) motor, sector cams, a cam shaft, and bracket bearings, the bracket bearings being fixed on the base plate, the cam shaft being rotatably mounted on the bracket bearings and the cam shaft being further connected to the DC motor in a transmission way, the sector cams being fixed on the cam shaft, rolling wheels being mounted on a sector surface of each sector cam, and the sector cams being connected via the rolling wheels to the lifter disk in a transmission way.

10. The golf coach box according to claim 9, wherein the lifter mechanism further comprises synchronizing wheels and belts, the synchronizing wheels being provided on the cam shaft in a sleeve way, and one end of each belt being fixed to each synchronizing wheel and the other end thereof being fixed to the lifter disk.

11. The golf coach box according to claim 8, wherein the batting box further comprises a rotating disk, the rotating disk comprising an upper support tray and a lower support tray, the upper support tray being rotatably fixed on the lower support tray, and the base plate being fixed on the upper support tray.

12. The golf coach box according to claim 11, wherein the upper support tray is provided with circular sliding rails and the lower support tray is provided with rollers, the upper support tray being rotatably fixed via the circular sliding rails to the rollers, and a gyration braking mechanism is further provided between the upper support tray and the lower support tray.

13. The golf coach box according to claim 8, wherein the bottom of the base plate is provided with a rotating disk and at least two rotating wheels, a lower surface of the rotating disk being positioned at the same horizontal plane with lower ends of the rotating wheels.

14. The golf coach box according to claim 1, wherein the swing plane sliding rail is provided with segmentation marks.

15. The golf coach box according to claim 14, wherein the segmentation marks are selected from the group consisting of a start swing segment mark, a back swing segment mark, a down swing segment mark, a release segment mark, a batting segment mark, and a forward swing segment mark.

16. The golf coach box according to claim 15, wherein the segmentation marks are coatings in different colors coated on the swing plane sliding rail.

17. The golf coach box according to claim 14, wherein the segmentation marks are coatings in different colors coated on the swing plane sliding rail.

18. The golf coach box according to claim 1, wherein the telescopic connecting mechanism is a telescopic rod or a telescopic cylinder, one end of the telescopic rod or the telescopic cylinder being rotatably connected to the swing plane sliding rail and the other end thereof being rotatably and detachably fixed to an outer edge of the batting box.

19. The golf coach box according to claim 18, further comprising a laser addressing device.

20. The golf coach box according to claim 19, wherein the laser addressing device is mounted on the batting box.

21. The golf coach box according to claim 18, wherein the swing plane sliding rail is provided with a swing rhythm display.

22. The golf coach box according to claim 18, wherein the outer edge of the batting box is provided with a swing plane sliding rail fixation mechanism.

23. The golf coach box according to claim 22, further comprising a laser addressing device.

24. The golf coach box according to claim 23, wherein the laser addressing device is mounted on the batting box.

25. The golf coach box according to claim 22, wherein the swing plane sliding rail comprises a swing plane sliding rail body, a square rubber shock absorption pad, and a nylon strip track; an upper end of the swing plane sliding rail body is provided with a U-shaped groove, the square shock absorption pad being mounted in the U-shaped groove; and an upper end of the square rubber shock absorption pad is provided with a recess, the nylon strip track being mounted in the recess.

26. The golf coach box according to claim 25, wherein the swing plane sliding rail further comprises a flexible neon line; and the nylon strip track is a transparent or semi-transparent hollow nylon strip track, the flexible neon line passing through the hollow nylon strip track.

27. The golf coach box according to claim 25, wherein the swing rhythm display is LED indicator lights, the LED indicator lights being arranged on an inner side of the swing plane sliding rail body.

28. The golf coach box according to claim 22, wherein the swing plane sliding rail is provided with a swing rhythm display.

29. The golf coach box according to claim 22, wherein the batting box comprises a lifter disk, a base plate, and a lifter mechanism, one end of the lifter disk being rotatably connected to one end of the base plate and the other end of the lifter disk being connected via the lifter mechanism to the other end of the base plate.

30. The golf coach box according to claim 29, wherein the bottom of the base plate is provided with a rotating disk and at least two rotating wheels, a lower surface of the rotating disk being positioned at the same horizontal plane with lower ends of the rotating wheels.

31. The golf coach box according to claim 29, wherein the batting box further comprises a rotating disk, the rotating disk comprising an upper support tray and a lower support tray, the upper support tray being rotatably fixed on the lower support tray, and the base plate being fixed on the upper support tray.

32. The golf coach box according to claim 31, wherein the upper support tray is provided with circular sliding rails and the lower support tray is provided with rollers, the upper support tray being rotatably fixed via the circular sliding rails to the rollers, and a gyration braking mechanism is further provided between the upper support tray and the lower support tray.

33. The golf coach box according to claim 29, wherein the lifter mechanism is a cam lifter mechanism, the cam lifter mechanism comprising a direct current (DC) motor, sector cams, a cam shaft, and bracket bearings, the bracket bearings being fixed on the base plate, the cam shaft being rotatably mounted on the bracket bearings and the cam shaft being further connected to the DC motor in a transmission way, the sector cams being fixed on the cam shaft, rolling wheels being mounted on a sector surface of each sector cam, and the sector cams being connected via the rolling wheels to the lifter disk in a transmission way.

34. The golf coach box according to claim 33, wherein the lifter mechanism further comprises synchronizing wheels and belts, the synchronizing wheels being provided on the cam shaft in a sleeve way, and one end of each belt being fixed to each synchronizing wheel and the other end thereof being fixed to the lifter disk.

35. The golf coach box according to claim 18, wherein the swing plane sliding rail comprises a swing plane sliding rail body, a square rubber shock absorption pad, and a nylon strip track; an upper end of the swing plane sliding rail body is provided with a U-shaped groove, the square shock absorption pad being mounted in the U-shaped groove; and an upper end of the square rubber shock absorption pad is provided with a recess, the nylon strip track being mounted in the recess.

36. The golf coach box according to claim 35, wherein the swing plane sliding rail further comprises a flexible neon line; and the nylon strip track is a transparent or semi-transparent hollow nylon strip track, the flexible neon line passing through the hollow nylon strip track.

37. The golf coach box according to claim 35, wherein the swing rhythm display is LED indicator lights, the LED indicator lights being arranged on an inner side of the swing plane sliding rail body.

38. The golf coach box according to claim 18, wherein the batting box comprises a lifter disk, a base plate, and a lifter mechanism, one end of the lifter disk being rotatably connected to one end of the base plate and the other end of the lifter disk being connected via the lifter mechanism to the other end of the base plate.

39. The golf coach box according to claim 38, wherein the bottom of the base plate is provided with a rotating disk and at least two rotating wheels, a lower surface of the rotating disk being positioned at the same horizontal plane with lower ends of the rotating wheels.

40. The golf coach box according to claim 38, wherein the batting box further comprises a rotating disk, the rotating disk comprising an upper support tray and a lower support tray, the upper support tray being rotatably fixed on the lower support tray, and the base plate being fixed on the upper support tray.

41. The golf coach box according to claim 40, wherein the upper support tray is provided with circular sliding rails and the lower support tray is provided with rollers, the upper support tray being rotatably fixed via the circular sliding rails to the rollers, and a gyration braking mechanism is further provided between the upper support tray and the lower support tray.

42. The golf coach box according to claim 38, wherein the lifter mechanism is a cam lifter mechanism, the cam lifter mechanism comprising a direct current (DC) motor, sector cams, a cam shaft, and bracket bearings, the bracket bearings being fixed on the base plate, the cam shaft being rotatably mounted on the bracket bearings and the cam shaft being further connected to the DC motor in a transmission way, the sector cams being fixed on the cam shaft, rolling wheels being mounted on a sector surface of each sector cam, and the sector cams being connected via the rolling wheels to the lifter disk in a transmission way.

43. The golf coach box according to claim 42, wherein the lifter mechanism further comprises synchronizing wheels and belts, the synchronizing wheels being provided on the cam shaft in a sleeve way, and one end of each belt being fixed to each synchronizing wheel and the other end thereof being fixed to the lifter disk.

* * * * *